United States Patent [19]

Harwood

[11] Patent Number: 5,025,355

[45] Date of Patent: Jun. 18, 1991

[54] COMBINATION LIGHTING FIXTURE AND GRAPHIC DISPLAY MEANS

[76] Inventor: Ronald P. Harwood, 31110 Applewood, Farmington Hills, Mich. 48018

[21] Appl. No.: 431,292

[22] Filed: Nov. 3, 1989

[51] Int. Cl.[5] ..... F21S 1/02

[52] U.S. Cl. ..... 362/147; 362/223; 362/225; 362/812; 362/374; 40/553

[58] Field of Search ..... 362/217, 218, 220, 221, 362/222, 223, 225, 285, 287, 290, 342, 145, 147, 368, 370, 372, 249, 250, 125, 812, 374, 375; 40/553, 558, 559, 541

[56] References Cited

U.S. PATENT DOCUMENTS

| | | | |
|---|---|---|---|
| 2,332,138 | 10/1943 | Epstein | 362/223 |
| 2,514,049 | 7/1950 | Graham | 362/812 |
| 2,540,271 | 2/1951 | Lytton | 362/263 |
| 2,592,444 | 4/1952 | Matelena | 362/812 |
| 3,154,001 | 10/1964 | Zurawski | 362/148 |
| 3,364,348 | 1/1968 | Dameral | 362/221 |
| 3,430,039 | 2/1969 | Piccola | 362/228 |
| 3,486,261 | 12/1969 | Hardesty | 40/546 |
| 3,600,569 | 8/1971 | Matteson | 362/309 |
| 3,797,914 | 3/1974 | Aiken | 362/290 |
| 4,323,954 | 4/1982 | Florence et al. | 362/374 |
| 4,335,348 | 10/1982 | Williams | 362/800 |
| 4,414,609 | 11/1983 | Shemitz | 362/33 |
| 4,419,717 | 12/1983 | Price et al. | 362/148 |
| 4,574,336 | 3/1986 | Mikalonis | 362/260 |
| 4,591,957 | 5/1986 | Harwood | 362/148 |
| 4,688,154 | 8/1987 | Nilssen | 362/147 |
| 4,835,915 | 6/1989 | Nilssen | 362/147 |
| 4,856,216 | 8/1989 | Gross | 40/558 |
| 4,939,627 | 7/1990 | Herst et al. | 362/328 |

*Primary Examiner*—Stephen F. Husar
*Assistant Examiner*—D. M. Cox
*Attorney, Agent, or Firm*—Dykema Gossett

[57] ABSTRACT

A combination lighting fixture and graphic display means is disclosed for suspension from a ceiling having a concealed raceway for wiring and lighting transformers, while at the same time having an integral lighting track to which may be mounted track lights and which also produces direct downward lighting, and indirect uplighting, while providing illuminated display panels to which graphics may be applied.

25 Claims, 5 Drawing Sheets

COMBINATION LIGHTING FIXTURE AND GRAPHIC DISPLAY MEANS

FIELD OF THE INVENTION

The present invention relates to lighting fixtures, and more particularly to commercial lighting fixtures which serve a dual purpose of providing lighting and illuminated graphic display means. Such lighting fixtures are particularly suited for use in large retail establishments.

DESCRIPTION OF THE PRIOR ART

Efforts have been under way, virtually since the birth of the advertising industry, to provide better, and more cost effective, ways to deliver messages to consumers who are shopping in retailing establishments. Until the present invention, all of these efforts resulted in single purpose graphic displays, i.e., lighted sign boxes, indirectly lighted signs, signs lighted by spot lights and like, or moving electronic signs, all of which served only the purpose of delivering only the graphic message, and nothing more.

While such single purpose signs were as cost effective as they could be, and efforts were continually made to reduce the cost thereof, it was not until I, as one with long experience in the lighting industry, studied the problem of how to provide cost effective graphic displays, that a dual purpose light fixture and graphic display was conceived which I believe to be more cost effective than any of the presently available single purpose display means.

Before filing the present application, I caused a search to be made through the records of the United States Patent and Trademark Office to determine if there were any combination lighting fixtures and graphic display means embodying the ideas of the present invention. The R. C. Dameral U.S. Pat. No. 3,364,348, E. F. Zurawski U.S. Pat. No. 3,154,001, and the Price, et. al. U.S. Pat. No. 4,419,717 were located. All of these patents have to do with providing an indirect florescent lighting fixture, and do have some of the features of the present invention, such as a concealed wire way. However, none of these patents show the combination of the lighting fixture with the graphic display means, and none of these fixtures show how to make this combination with the additional features of track lighting, uplighting, and adjustable angle downward illumination.

SUMMARY OF THE INVENTION

In order to provide a combination lighting fixture and graphic display means which solves the above mentioned problems in the art, I have provided a lighting fixture having a fixture body of a desired shape, with track slot provided proximate the middle of the lower wall thereof. The fixture body has slots at the upper extremities thereof for the mounting of graphic display panels, and support ledges adjacent the slots to provide for attachment of a raceway cover which will support a light source. A top cap closes the top of the fixture and extends between the display pannels.

Thus, it is an object of the present invention to provide several embodiments of a combination lighting fixture and graphic display means.

It is a further object of the present invention to provide a combination graphic display means and lighting fixture of the forgoing nature which has an enclosed raceway to contain lighting ballast and wiring.

A still further object of the present invention is to provide a combination lighting fixture and graphic display means which provides for the mounting of track lighting to the bottom of said lighting fixture.

A still further object of the present invention is to provide a direct/indirect lighting fixture having integral lighting and display means.

A still further object of the present invention is to provide a combination graphic display means and lighting fixture having adjustable uplighting capability.

A still further object of the present invention is to provide a light fixture of the forgoing nature providing adjustable direct lighting.

A still further object of the present invention is to provide a light fixture of the forgoing nature wherein the light source therein may either be florescent, incandescent, or neon in nature.

A still further object of the present invention is to provide a combination lighting fixture and graphic display means having provisions for quick disconnect track lighting, wherein no tools are required.

A still further object of the present invention is to provide a combination light fixture and graphic display means wherein the graphic display means may be part translucent and part solid.

A further object of the present invention is to provide a combination graphics display and lighting fixture where the fixture body may be provided in various sizes and shapes.

Further objects and advantages of the present invention will be apparent from the following description and appendent claims, reference being made to the accompanying drawings forming a part of the specification, wherein like reference characters designate corresponding parts in the several views.

It is to be understood that the present invention is not limited in its application to the details of construction or arrangement of parts illustrated in the acompanying drawings, since the invention is capable of other embodiments, and of being practiced or carried out in various ways within the scope of the claims. Also, it is to be understood that the phraseology and terminology employed herein is for the purpose of description, and not of limitation.

DESCRIPTION OF THE PREFERRED EMBODIMENTS

Figure 1:
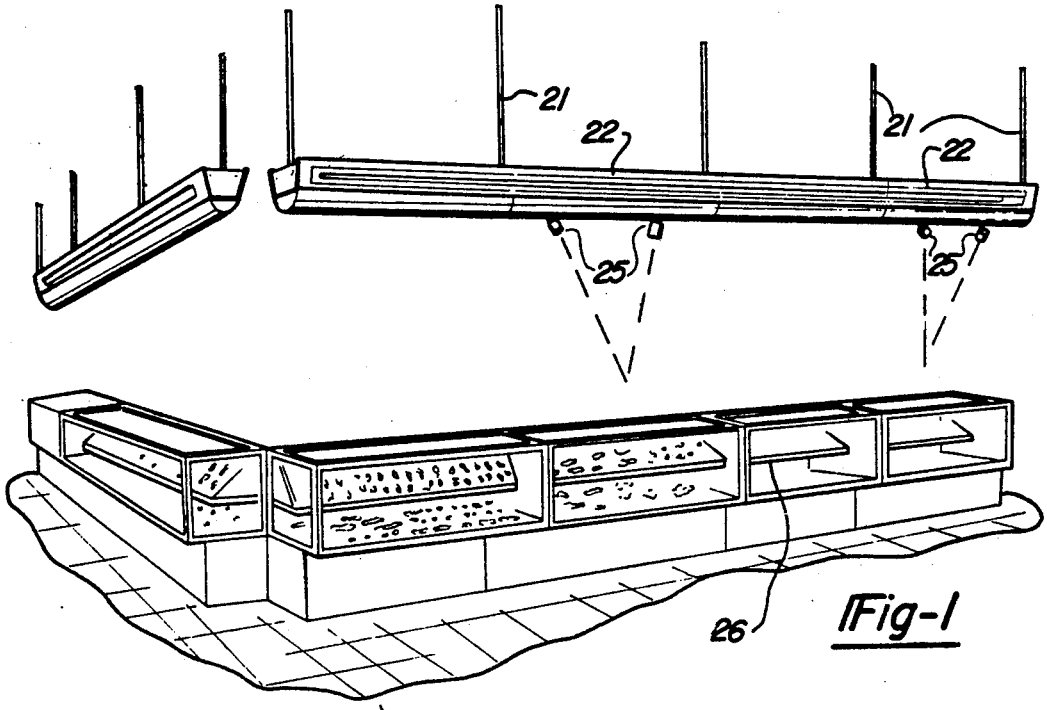
FIG. 1 is a perspective view showing a construction embodying the present invention installed in a retail establishment.

Referring now to FIG. 1, there is shown a construction embodying the present invention wherein my improved combination lighting fixture and graphic display means, generally indicated by the numeral 20, is supported by hollow struts 21 from a ceiling (not shown) in a retail establishment. Graphic display pannels 22 are shown mounted above a fixture body 24, which may be of any desired size and shape. Track lights 25 are mounted in a slot 29 in the fixture body in a manner to be discribed hereinafter in more detail. The track lights 25 direct illumination to the retail sales counter 26 as well as in other desired directions.

Figure 2:
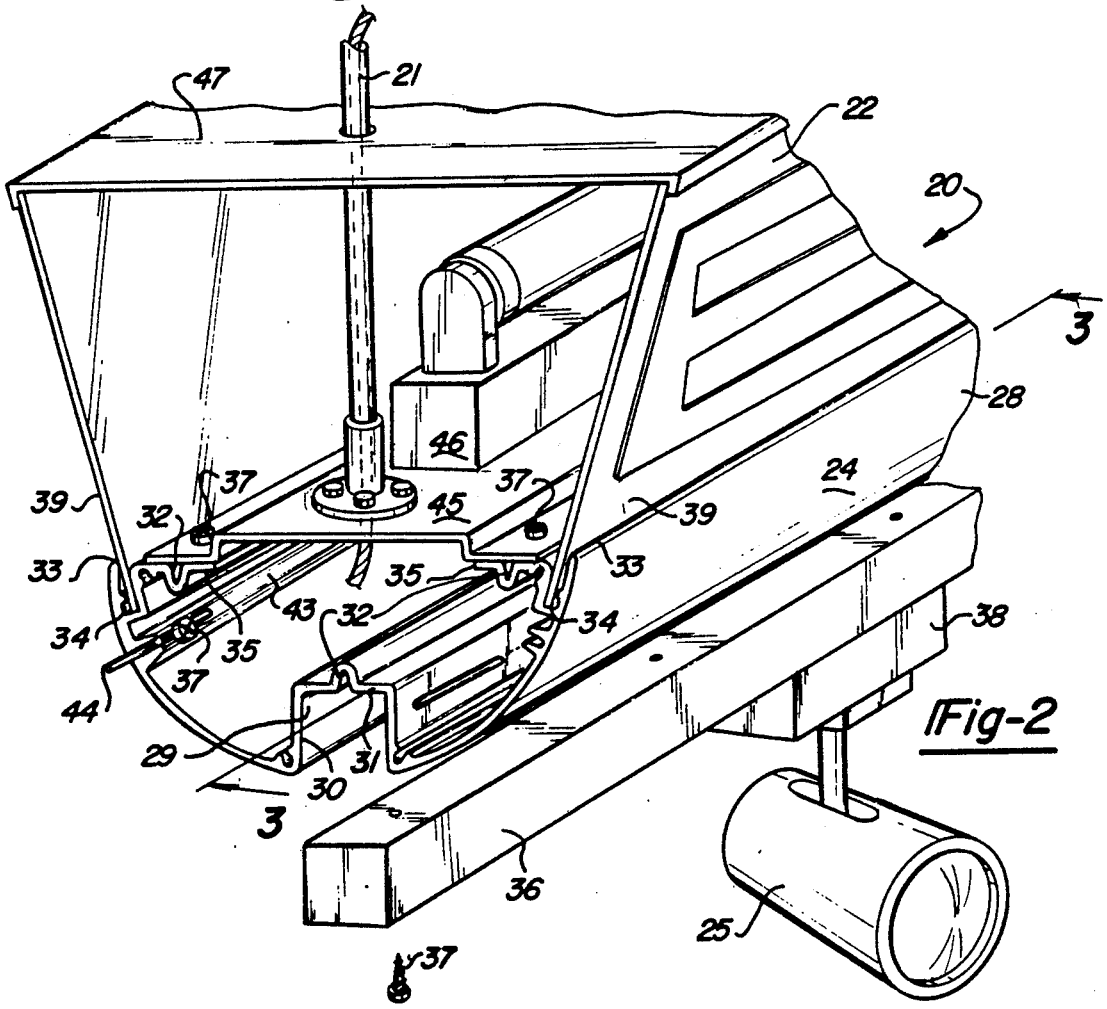
FIG. 2 is a partial, perspective, exploded view showing a construction embodying the present invention.

Referring now to FIG. 2 my invention can be seen in greater detail. As can be seen, a construction embodying my invention may include a fixture body 24, which it is important to understand can be of any desired size and shape, and not just the semi-circular shape illustrated in FIG. 2. The fixture body generally comprises a lower wall portion 28 having a track slot 29 positioned proximate the middle thereof. The track slot 29 has side walls 30, and a top wall 31. A screw receiving slot 32 is positioned proximate the middle of the top wall 31. A screw receiving slot 32 is positioned proximate the middle of the top wall 31 for purposes to be described.

It should be understood that it is preferred, but not necessary, that the track slot 29 be provided. It is contemplated that for most uses my combination lighting fixture and graphic display means will be used as a direct/indirect lighting fixture, and the track slot 30 will be desired, so that the lighting track 36 can be installed therein by the use of screws 37, so that track lights 25 mounted to track head 38 may supply direct lighting to the sales counters 28 or displays 27 appearing in conventional retail establishments.

Power is supplied to my improved lighting fixture by way of power supply wire 15 which is led into the interior thereof through hollow strut 21, which is attached to the raceway cover 45 by the flanged coupling 16 and bolts 17.

It is easily seen that the track lights 25 may be directed anywhere where direct lighting is necessary. Proximate the top edges 33 of the lower wall portion 28 are provided mounting slots 34 into which graphic display panels 22 are placed. These graphic display panels 22 may be solid, translucent or in the nature of a lens defuser, and will be described in greater detail hereinafter. To provide the indirect lighting means of the present invention, a raceway cover 45 is provided which extends between the support shelves 35 and is fastened thereto by screws 37 in the additional screw receiving slots 32, which are provided in the support shelves 35. To the raceway cover 45 is mounted a fluorescent light source 46.

One of the principal advantages of my invention is that the combination of the fixture body 24 and raceway cover 45 provide a completely concealed raceway for the containing of the wiring coming from the wiring supply to the fluorescent fixture. As will be explained in greater detail hereinafter, the term "light source" should be construed broadly to not only cover the fluorescent light source 46 shown in this example, but the incandescent and neon light sources which will be described in greater detail hereinafter. It is the mounting of the light source to the raceway cover which provides the indirect lighting means of the present invention, regardless of the type of light used.

In many applications of my invention, a fluorescent light source 46 will be mounted on a one piece raceway cover 45. A piece of translucent plastic will form the removable graphics panels 22, and a solid top cap 47 will be used to complete my construction where uplighting is not desired. An end cap 42 (FIG. 3) will close off the ends of the light fixture where it is not ganged to another light fixture.

If it is desired to gang several light fixtures 20 together, the alignment slots 43, which may be the same as the screw receiving slots 32, may be used. Alignment pins, 44 are placed at the end of each slot 43, and are fastened in place by screws 32. The pins are then placed in the alignment slot 44 in the adjacent fixture and tightened down with additional screws 37.

Figure 4:
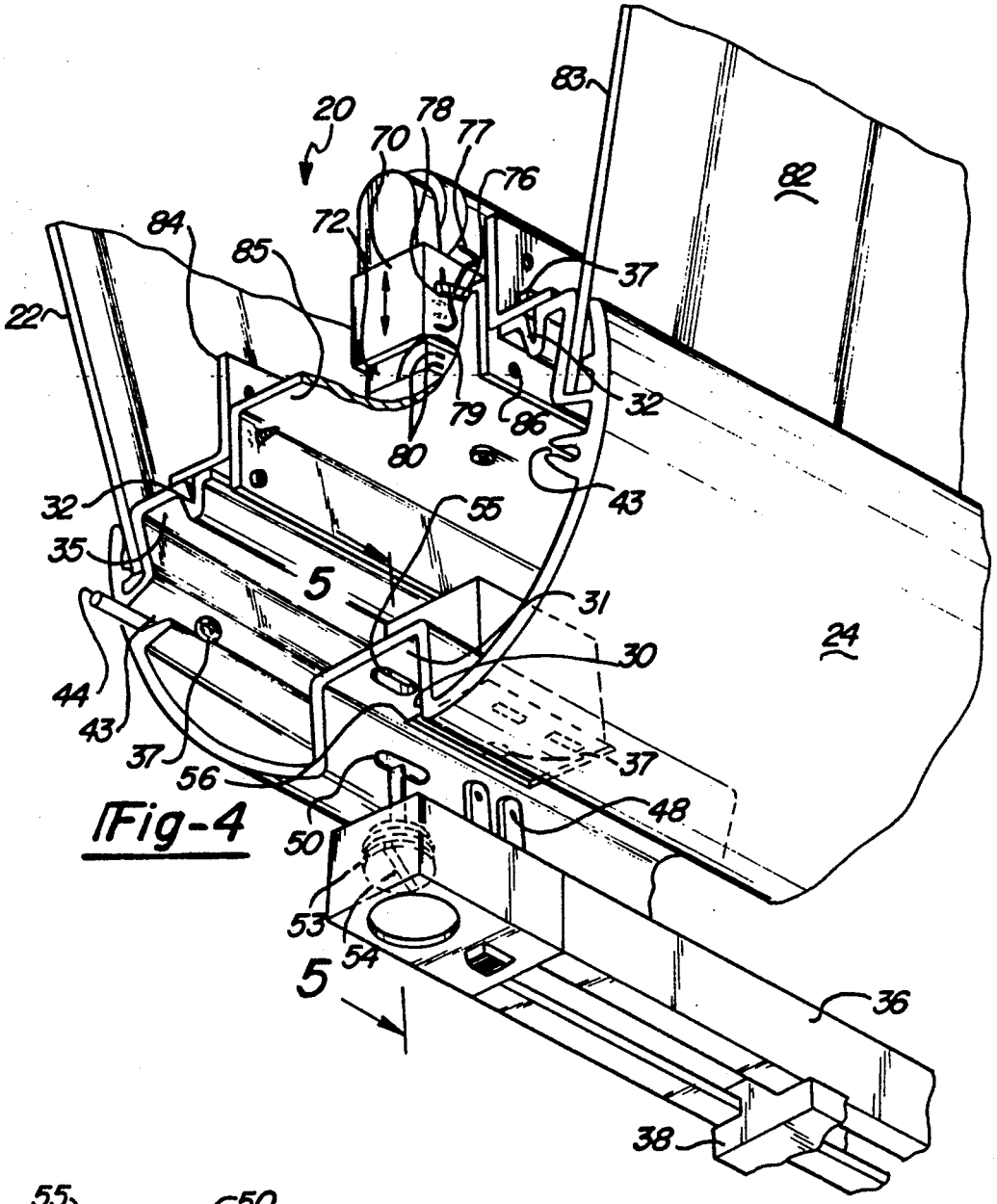
FIG. 4 is a view similar, in part, to FIG. 2, but showing a modification of my invention having an adjustable lamp platform, and a quick-disconnect light track.
Figure 5:
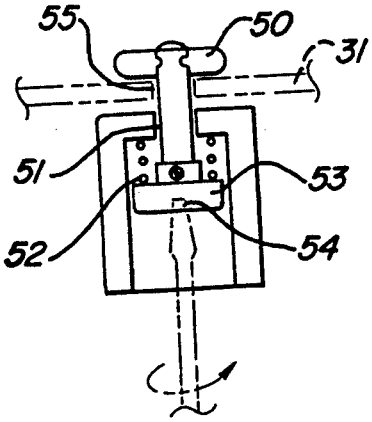
FIG. 5 is a sectional view, taken in the direction of the arrows, along the section line 5—5 of FIG. 4.

A modification of the construction shown in FIG. 2 can be seen in FIG. 4, and this involves a modification to the conventional light track 36 by having a plug 48 provided therein at a predetermined position, which mates with a recepticle 49, which is held in place by the screw 37 provided in the screw receiving slot 32, provided in the top wall 31 of the track slot 29, and which projects through the receptacle opening 56. In this way it is not necessary to direct wire the light track 36 to the fixture, and the light track 36 with the track head 38 and the track lights 25 can be more easily moved from location to location, since the recepticles 49 can be permanently mounted and wired in place at the factory.

If desired to make a true quick disconnect light track 36, a further modification, wherein a spring loaded locking bolt 50 is mounted, by means of hole 51 provided in light track 36, and spring 52, to the light track 36, and is retained in place by screw head 53 having slot 54 is provided. The plugs 48 and the locking bolt 50 will be provided at predetermined intervals on the light track 36 so that no permanent connection whatever is needed between the light track 36 and the track slot 29. In one embodiment of my invention, the locking bolts 50 are provided every two feet on the light track, and mate with the elongated slots 55 provided at the same distances in the top wall 29 of the light track. With the recepticles 49 permanently mounted and wired in place at the factory, and with no permanent connection needed between the light track 36 and the slot 29, the entire light track assembly consisting of the light track 36, the track head 38, and the track lights 25 may easily be moved from place to place along the length of the lighting fixture and graphic display means 20, and even may be conveniently moved from fixture to fixture depending on where the direct lighting supplied by the track lights 25 is required.

Figure 3:
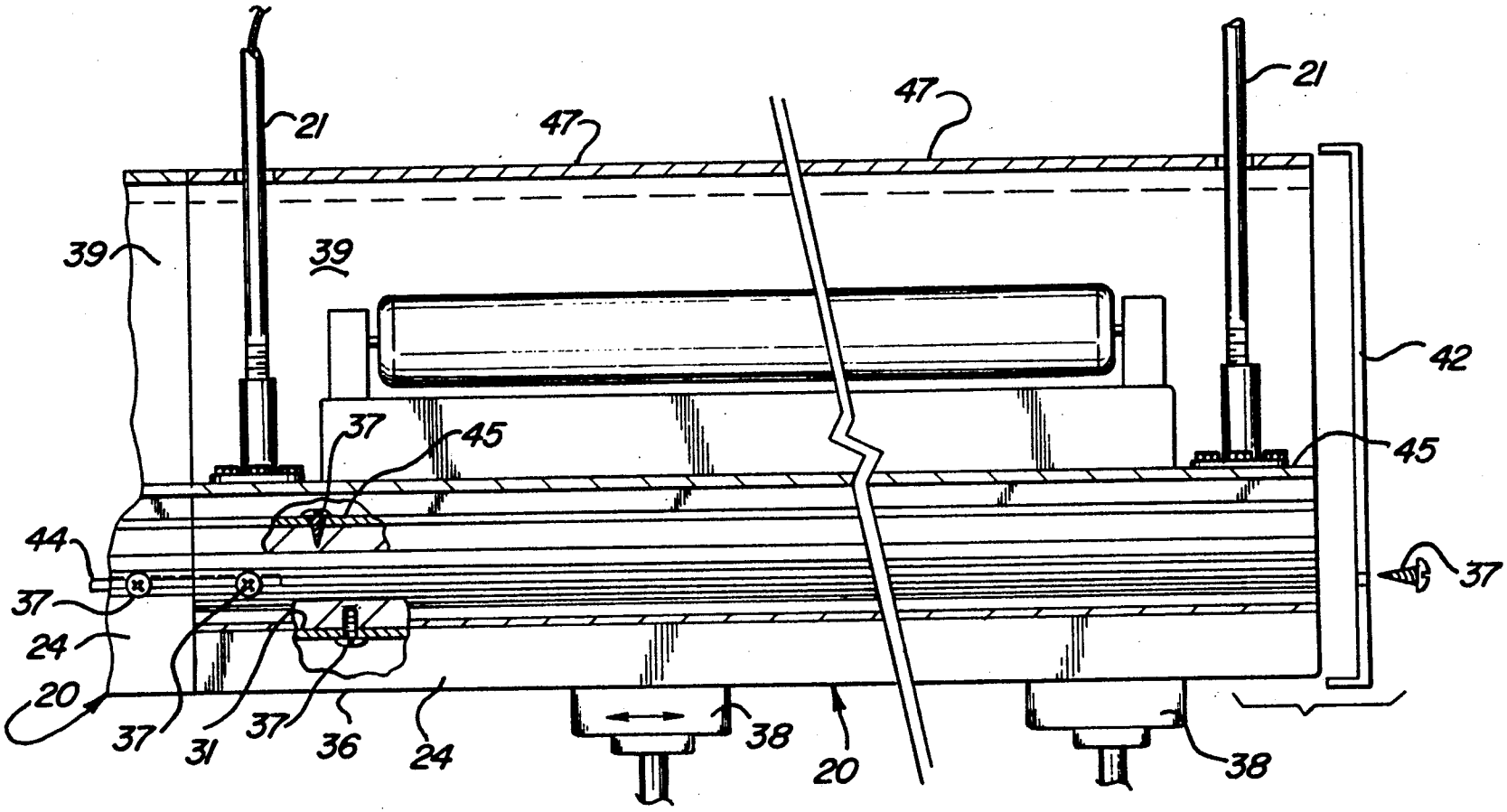
FIG. 3 is a sectional view, taken in the direction of the arrows, along the section line 3-2 of FIG. 2.

It should be understood that portions of the lighting fixture 20 may have a permanently mounted light track some portions of the fixture may have the embodiment of the light track shown in FIG. 3 and other portions may have the embodiment shown in FIG. 4, all of this being well within the scope of the present invention.

Figure 8:
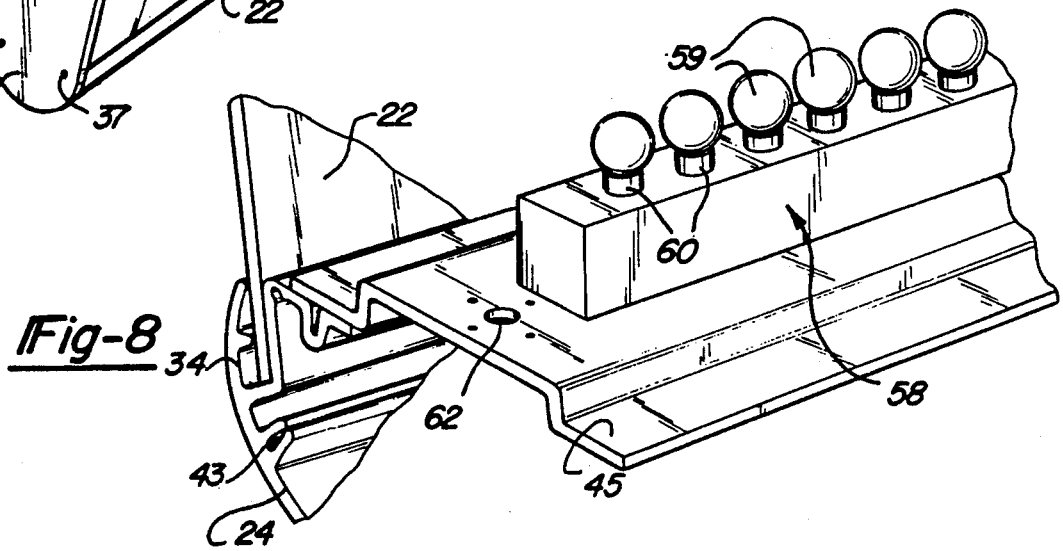
FIG. 8 is a partial, perspective, view showing a modification of my invention having an incandescent light source.

As previously mentioned, the term "light source" is used broadly in the present application. Referring now to FIG. 8 can be seen that an incandescent light source, generally designated by the numeral 58, and including a plurality of incandescent lamps 59, screwed into sockets 60, in lamp base 61, provide the source of light. The lamp base 61 is mounted by means well known in the art to the raceway cover 45 which, as before, is mounted to the support shelves 35 by the screws 37 received in the screw receiving slots 32.

Figure 9:
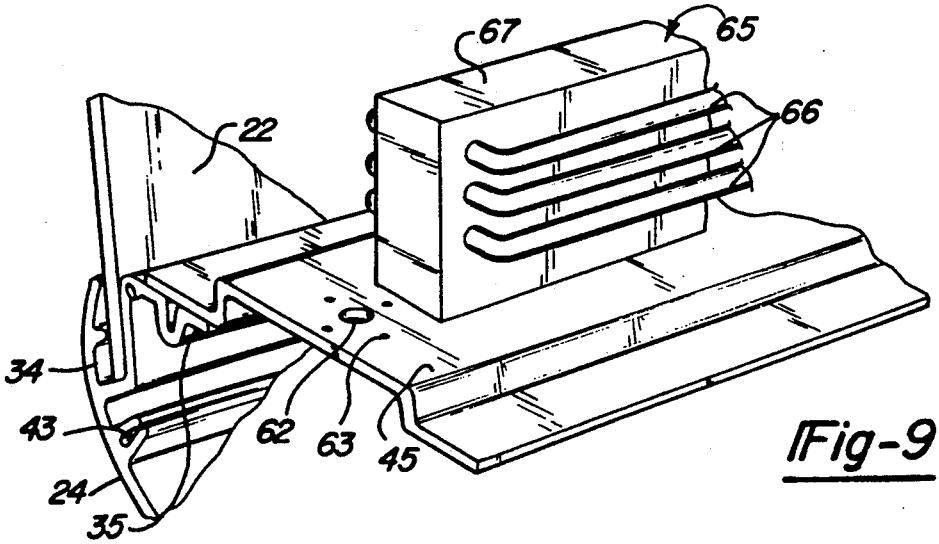
FIG. 9 is a view similar to that shown in FIG. 8 showing how a neon light source may be provided.

Now referring to FIG. 9, it is believed that in instances, for special lighting effects, a neon light source, generally designated by the numeral 65, may be desired in place of either the incandescent light source 58, or the fluorsecent light source 46 previously described. In this embodiment, the neon light source 65 consists of a neon lamp base 67 mounted to the raceway cover 45 by conventional means, and having the desired number of neon lamps 66 mounted thereto. The neon lamps may be all of the same color, or may be varied in color, depending upon the particular application.

Thus far, the modifications to my construction dealing with substitution of light sources has been directed to obtaining different lighting effects. However, referring again to FIG. 4, it can be seen that modifications to my invention can be made to vary the direction of the light as well as the type of light source. For ease of illustration, I have illustrated this modification with a fluorescent light source 46, but it may be used just as easily with an incandescent light source 58, or a neon light source 65, although it is contemplated that the fluorescent light source 46 will be the most commonly used.

In this embodiment, the fluorescent source 46 is mounted to an adjustable lamp platform, generally designated by the numeral 70. The adjustable lamp platform 70 has an upper base portion 71 and a lower base portion 72. The lower base portion 72 may be mounted either to the one piece raceway cover 45 previously described, or to the adjustable raceway cover 75 illustrated in FIG. 4. A plurality of height adjustment means, generally designated by the numeral 76, is used to adjust the height of the upper base portion 71 of the adjustable lamp platform 70. Any height adjustment means may be used, but in the preferred embodiment of the invention the height adjustment means comprise a plurality of height adjustment levers 77, pivotly mounted to the upper base portion 71, by a stamped mounting arm 78. The lower portion of the spring loaded height adjustment lever 77 is formed into a leveling pin 79 which protrudes through a hole 80 in the upper base portion. The hole 80 in upper base portion 70 is in alignment with a plurality of holes 80 provided in the lower base portion. It can be seen that the upper base portion may be adjusted to several heights relative to the lower base portion in this way. For ease of illustration a single height adjustment lever has been shown, but it should be understood that a sufficient number of height adjustment levers would be provided to provide for the upper base platform 71 remaining in the desired position once it is adjusted.

The adjustable lamp platform 70 is used in combination with a lens defuser 82 which now replaces the graphic display panel 22. The lens defuser 82 will have a smooth front similar to that on the graphics display panels 22, but will have a series of lens 83 formed on the back thereof, which in combination with different heights of the lamp platform 70, will vary the direction of the light coming from the light source 46. With the light source 46 being adjusted to its highest level by height adjustment lever 77, the light passing through the lens defuser 82 is focused in the most downward direction relative to the light fixture 20, while when the light source 46 is at its lowest position, the light is directed in more lateral direction.

Also shown in FIG. 3 is an adjustable raceway cover 75, which is used when it is necessary to accommodate over sized ballasts, or other electrical components. In this construction, the one piece raceway cover 45 is replaced by a pair of brackets 84 mounted to the support shelves 35 by the screws 37. These right angle brackets are connected to an inverted channel 85 by screws 37 which engage one of several adjustment holes 86 in the channel. In this way, regardless of which type of light source is used, and what type ballast or other wiring is required, it can be accommodated by an adjustment in height of the inverted channel 86.

Figure 10:
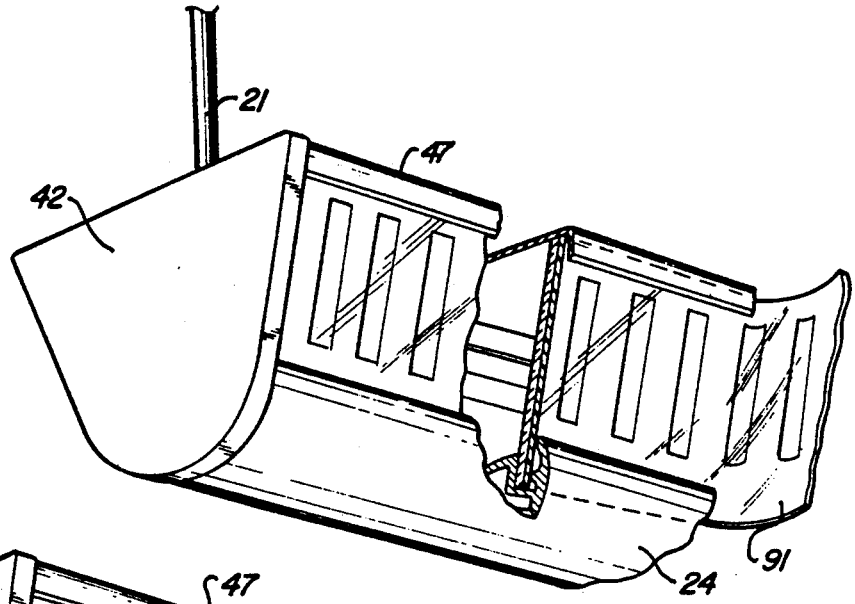
FIG. 10 is a partial, perspective, view showing how one of the graphics display panels may have transparencies mounted thereto.

Referring to FIGS. 2 and 10–12 there are shown various methods of applying graphics to the graphic display panels 22 or lens defusers 76. As shown in FIG. 2, various designs such as the stripes 90 may be applied to the graphic display panels 22 by a silk screen or vinyl sticker process, as illustrated by the vinyl sticker 90. In FIG. 10 graphics are applied to the graphic display panels 22 by means of transparencies 91.

Figure 12:
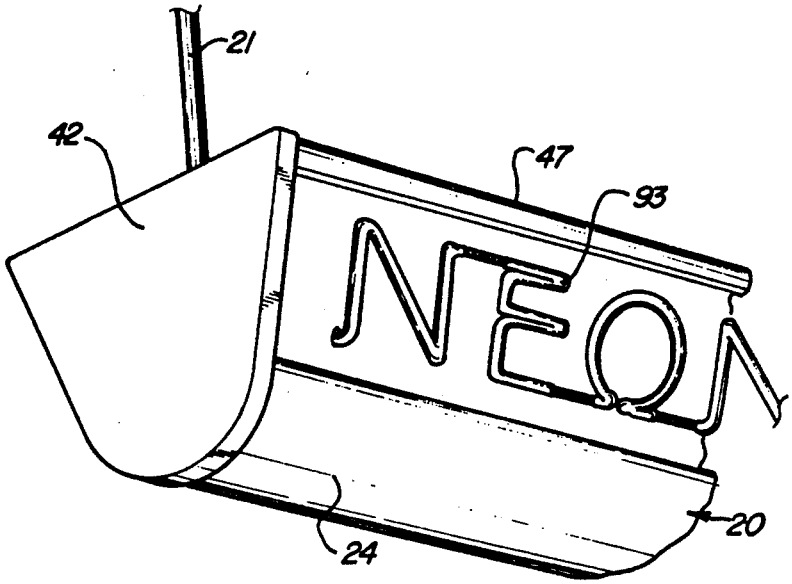
FIG. 12 is a partial, perspective view, similar in part to FIG. 11 showing how neon signage may be mounted to the graphic display panel.

Referring to FIG. 12, there is shown a modification of my invention where at least a portion of a graphic display panel 22 is made of a solid material and has neon signage 93 mounted thereon.

Figure 11:
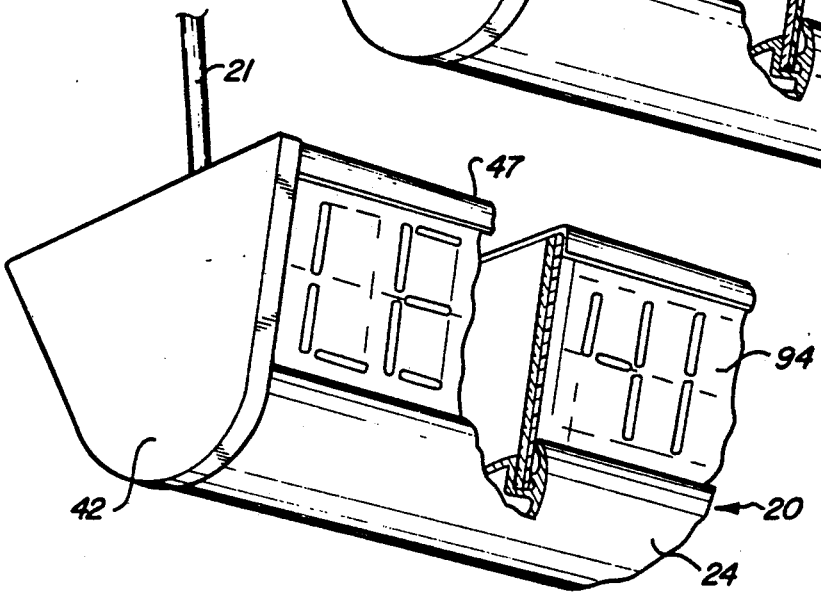
FIG. 11 is a partial, perspective view, similar in part to FIG. 10, but showing liquid crystal or light emiting diode type displays mounted on the graphics display panel.

Similar to that shown in FIG. 12, as shown in FIG. 11, the graphics display panel 22 is solid and has either a liquid crystal display 94 and/or a light emitting diode mounted thereon. With regard to the above examples the neon signage, the liquid crystal, or the light emitting diode, may be used regardless of what material the graphics display 22 is made out of.

Figure 7:
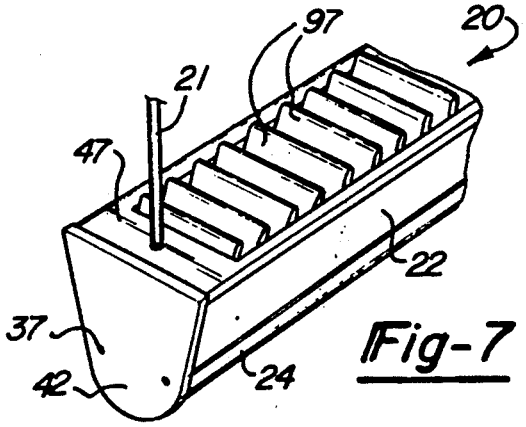
FIG. 7 is a partial, perspective, view of a modification of my invention showing adjustable louvers being provided for adjustment of uplighting effects.
Figure 6:
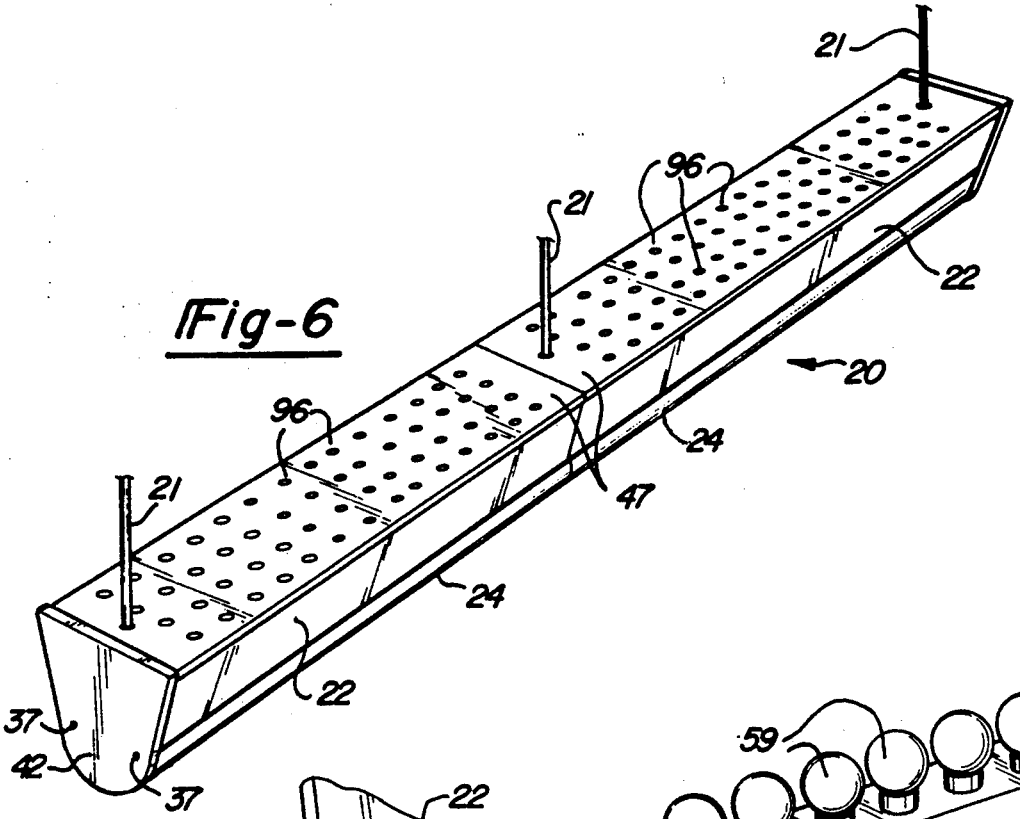
FIG. 6 is a partial, perspective, view showing how a perforated metal top cap may be used to regilate the uplight emiting from my improved lighting fixture.

Referring to FIGS. 6 and 7, there are shown modifications of the top cap 47 when it is desired to provide uplighting in addition to direct and indirect lighting. As shown in FIG. 6, a plurality of openings 96 may be provided in the top cap 47 to provide for uplighting effects. These openings may be in all or part of the top cap 47, may be of varying shapes and sizes, such as a portion of the openings 96 being circular in nature and a portion being rectangular in nature, or be provided in repetitive pattern.

As shown in FIG. 7, the top cap 47 may also be provided with a plurality of louvers 97 operationally mounted to the top cap 47 by conventional means for rotation from at least a fully closed to a vertical position and preferably through at least 180°.

Thus, it can be seen that by carefully analyzing the problems involved in presenting graphic messages to consumers in retailing establishments and applying my expertise in the lighting industry to these problems which has hereto for not been done I have invented a novel combination lighting fixture and graphic display means to form a hollow raceway.

I claim:

1. A lighting fixture and graphic display means including, in combination:

(a) a fixture body of a desired shape and cross-section, (b) a pair of slots formed in said fixture body proximate the upper longitudinal edges thereof,
(c) a pair of support shelves formed in said fixture body adjacent said slots,
(d) a raceway cover extending between and connected to said support shelves to form a hollow raceway within said fixture body,
(e) a light source mounted to said raceway cover, and
(f) upwardly extending graphic display means mounted in said slots in a position to receive light directly from said light source.

2. The combination defined in claim 1, and further including:
(a) a top plate mounted to said graphic display means.

3. The combination defined in claim 1, and further including:
(a) a track slot provided in said fixture body and extending axially therewith.

4. The combination defined in claim 2, wherein:
(a) a light track mounted in said track slot,
(b) a track head is mounted to said light track, and
(c) a track light is mounted to said track head.

5. The combination defined in claim 2, wherein:
(a) said track slot includes a pair of side walls and a top wall,
(b) at least one recepticle mounted in said top wall, and
(c) a light track for insertion into said track slot, said light track having at least one mating plug for inserting into said recepticle to supply power to said light track.

6. The device defined in claim 1, wherein said light source includes:
(a) a fluorescent light source mounted to said raceway cover.

7. The device defined in claim 1, wherein said illuminating means include:
(a) an adjustable lamp platform mounted to said raceway cover, and
(b) a fluorescent light source mounted to said adjustable lamp platform.

8. The device defined in claim 7, wherein said raceway cover is adjustable and includes an inverted channel fastened between a pair of brackets.

9. The device defined in claim 1, wherein said light source includes:
(a) at least one incandescent light source mounted to said raceway cover.

10. The device defined in claim 1, wherein said light source includes:
(a) at least one neon lamp source mounted to said raceway cover.

11. The combination defined in claim 1, wherein said graphic display means include:
(a) at least one solid graphics display panel mounted in said slot in said fixture body.

12. The combination defined in claim 1, wherein said graphic display means include:
(a) at least one translucent display panel mounted in said slot in said fixture body.

13. The combination defined in claim 11, wherein said solid graphics display panel has neon signage mounted thereto.

14. The combination defined in claim 12, wherein said combination further includes:
(a) graphics in the form of transparencies applied to said translucent panel.

15. The combination defined in claim 12, wherein said combination further includes:
(a) silk screen printing provided on said translucent panel.

16. The combination defined in claim 12, wherein said combination further includes:
(a) vinyl stickers applied to said translucent panel.

17. The combination defined in claim 12, wherein said combination further includes:
(a) transparencies applied to said translucent panels.

18. The combination defined in claim 11, wherein said graphic display means further include:
(a) liquid crystal display means.

19. The combination defined in claim 11, wherein said graphics display means further include:
(a) LED display means.

20. The combination defined in claim 12, wherein said graphic display means further includes:
(a) liquid crystal display means.

21. The combination defined in claim 12, wherein said graphic display means further includes:
(a) LED display means.

22. The combination defined in claim 5, wherein said light track is a quick disconnect light track and further includes:
(a) a plurality of elongated slots provided in said top wall of said track slot, and
(b) an equal plurality of spring loaded locking bolts mounted to said lighting track for insertion into said slots and for engagement therewith upon a twisting motion being applied thereto, thereby holding said light track in place.

23. The combination defined in claim 22, and further including an on/off dimming switch electrically connected to said plug.

24. The combination defined in claim 2, wherein said top plate has a plurality of holes provided therein.

25. The combination defined in claim 2, wherein said top plate has a plurality of adjustable directional louvers provided therein.

* * * * *